US011526095B2

(12) United States Patent
Uehara

(10) Patent No.: US 11,526,095 B2
(45) Date of Patent: Dec. 13, 2022

(54) IMAGE FORMING APPARATUS INCLUDING DETACHABLE DEVELOPMENT DEVICE

(71) Applicant: KYOCERA Document Solutions Inc., Osaka (JP)

(72) Inventor: Masakazu Uehara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/553,993

(22) Filed: Dec. 17, 2021

(65) Prior Publication Data

US 2022/0197184 A1 Jun. 23, 2022

(30) Foreign Application Priority Data

Dec. 23, 2020 (JP) ..... JP2020-213202

(51) Int. Cl.
*G03G 15/08* (2006.01)
*G03G 21/16* (2006.01)

(52) U.S. Cl.
CPC ..... *G03G 15/0865* (2013.01); *G03G 15/0898* (2013.01); *G03G 21/1676* (2013.01)

(58) Field of Classification Search
CPC ..... G03G 15/0865; G03G 15/0898; G03G 21/1676; G03G 21/1853
See application file for complete search history.

(56) References Cited

U.S. PATENT DOCUMENTS

2009/0110430 A1* 4/2009 Kubota ..... G03G 15/0898 399/103
2009/0110434 A1* 4/2009 Kusudo ..... G03G 21/1821 399/109
2011/0064454 A1* 3/2011 Xu ..... G03G 15/0898 399/284
2015/0192882 A1* 7/2015 Abe ..... G03G 15/0898 399/102
2016/0259271 A1* 9/2016 Ooyoshi ..... G03G 15/0817
2022/0197212 A1* 6/2022 Iino ..... G03G 21/1853

FOREIGN PATENT DOCUMENTS

JP 2015-011230 A 1/2015

* cited by examiner

*Primary Examiner* — Sophia S Chen
(74) *Attorney, Agent, or Firm* — Studebaker & Brackett PC

(57) ABSTRACT

An image forming apparatus includes an apparatus main body, an image carrier, a development device, a main body opening, and a guide rail. The main body opening is formed on an upper surface of the apparatus main body. The development device is movable along the guide rail between the main body opening and an attachment position. The development container has a container opening and a blocking member. The container opening is opened to a downstream side in an attachment direction of the development device. The blocking member is provided on the downstream side of the container opening in the attachment direction and stands upward from a lower end portion of the container opening. When the development container is disposed in a position where an inclination of the guide rail is largest, an inclination angle of the blocking member with respect to a horizontal plane is 80° to 130°.

7 Claims, 9 Drawing Sheets

IMAGE FORMING APPARATUS INCLUDING DETACHABLE DEVELOPMENT DEVICE

INCORPORATION BY REFERENCE

This application is based on and claims the benefit of priority from Japanese patent application No. 2020-213202 filed on Dec. 23, 2020, which is incorporated by reference in its entirety.

BACKGROUND

The present disclosure relates to an image forming apparatus using an electrophotographic process, such as a copying machine, a printer and a facsimile.

The image forming apparatus using an electrophotographic process, such as a copying machine, a printer, a facsimile and a multifunctional peripheral containing their functions, is provided with a development device which develops an electrostatic latent image formed on an outer circumferential surface of an image carrier, that is, forms a toner image (a developer image) which is a visual image of the electrostatic latent image. Such a development device used in the image forming apparatus may be detachably attached to an apparatus main body of the image forming apparatus.

The apparatus main body has a main body opening opened upward. In the apparatus main body, a guide rail along which the development device is guided from the main body opening to an attachment position of the development device is provided. The guide rail extends downward from the main body opening to the attachment position. The development device is moved along the guide rail in the apparatus main body.

The development device includes a development container in which a developer containing a toner is stored and a developer carrier which is disposed in contact with or adjacent to the image carrier and carries the developer. The development container has a container opening opened to the downstream side of the development device in the moving direction of the development device. The developer carrier is disposed so as to face the container opening. A part of the developer carrier is exposed to the outside of the development device through the container opening. The developer carrier can carry the developer around the outer circumferential surface. From the exposed part of the developer carrier, the toner in the development container is supplied to the image carrier.

By the way, as described above, a part of the developer carrier is exposed to the outside of the development device through the container opening. Then, near the container opening, the toner scattered when supplied to the outer circumferential surface of the development carrier or supplied from the developer carrier to the image carrier may be accumulated as a waste toner. Further, as describe above, the guide rail extends downward from the main body housing to the attachment position. Therefore, in the image forming apparatus, when the development device is attached to the apparatus main body (when the development device is moved along the guide rail), the downstream side portion of the development device in the moving direction, that is the container opening faces downward. Then, the waste toner accumulated around the container opening may fall in the apparatus main body. When the waste toner fallen in the apparatus main body may adhere to the image carrier or another unit in the apparatus main body, an image defect such as a waste toner transfer to a sheet (a recording medium) may be caused.

SUMMARY

In accordance with an aspect of the present disclosure, an image forming apparatus includes an apparatus main body, an image carrier, a development device, a main body opening, and a guide rail. The image carrier is provided in the apparatus main body and carries a toner image to be formed on a recording medium. The development device is provided to be attachable to and detachable from an attachment position in the apparatus main body, and supplies a toner to an outer circumferential surface of the image carrier. The main body opening is formed on an upper surface of the apparatus main body. The guide rail extends downward from the main body opening to the attachment position. The development device includes a development container in which a developer containing the toner is stored, a developer carrier which carries the developer and a guide part provided on an outside of the development container and engageable with the guide rail. The development device is movable along the guide rail between the main body opening and the attachment position. The development container has a container opening and a blocking member. The container opening is opened to a downstream side in an attachment direction of the development device to the attachment position, and through the container opening, a part of the developer carrier is exposed. The blocking member is provided on the downstream side of the container opening in the attachment direction and stands upward from a lower end portion of the container opening. When the development container is disposed in a position where an inclination of the guide rail is largest, an inclination angle of the blocking member with respect to a horizontal plane is 80° to 130°.

The other features and advantages of the present disclosure will become more apparent from the following description. In the detailed description, reference is made to the accompanying drawings, and preferred embodiments of the present disclosure are shown by way of example in the accompanying drawings.

DETAILED DESCRIPTION

Figure 1:
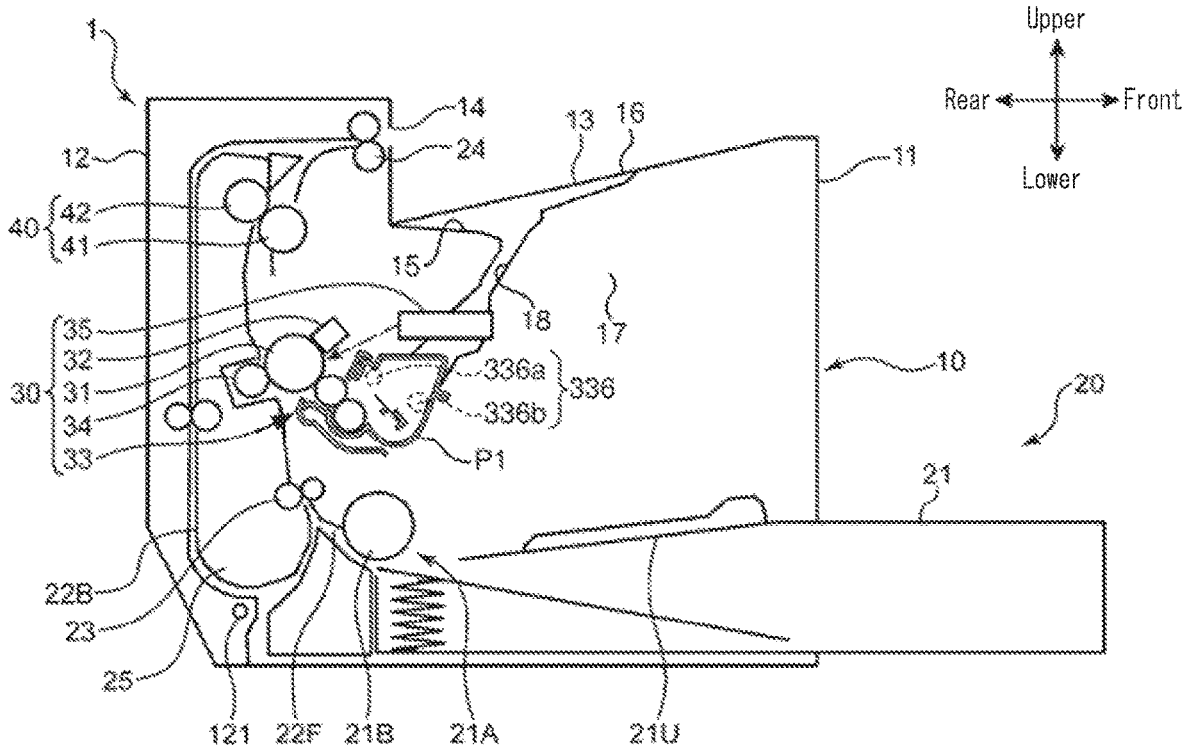
FIG. 1 is a side sectional view schematically showing a structure of an image forming apparatus 1 according to the present disclosure.
Figure 2:
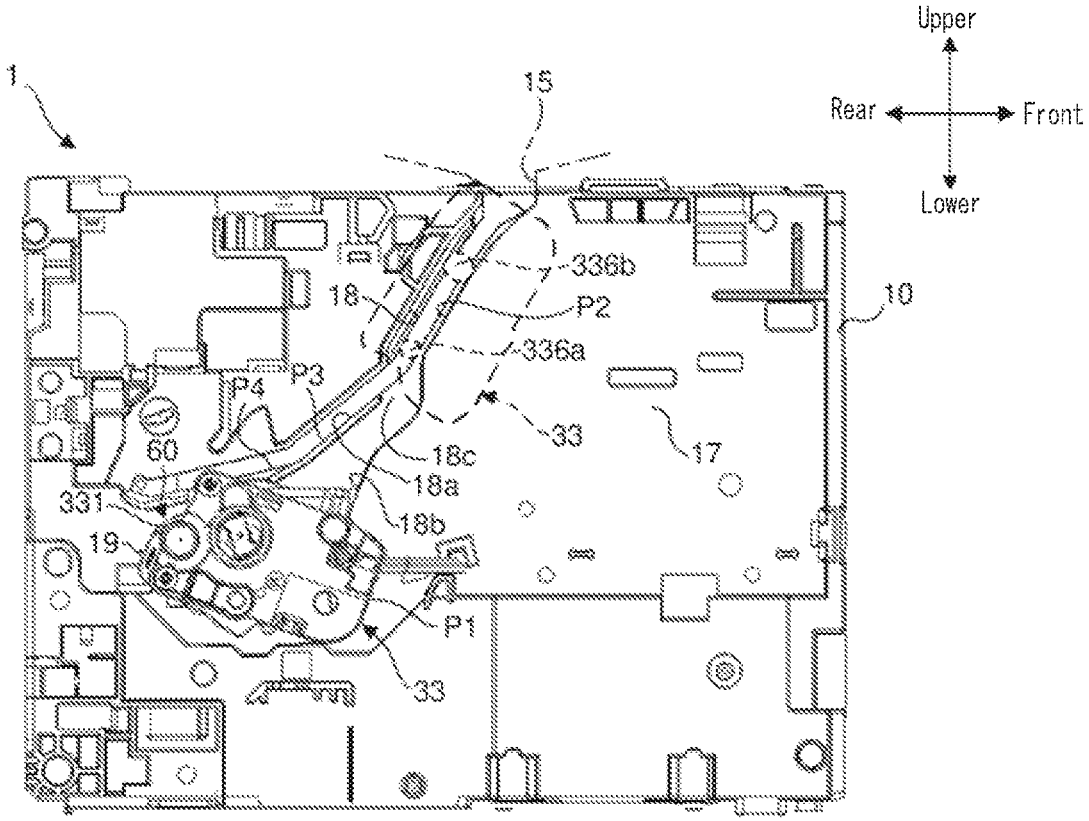
FIG. 2 is a plan view showing a guide rail 18 formed in a main body housing 10 and a development part 33 attached to the main body housing 10 at an attachment position P1.
Figure 3:
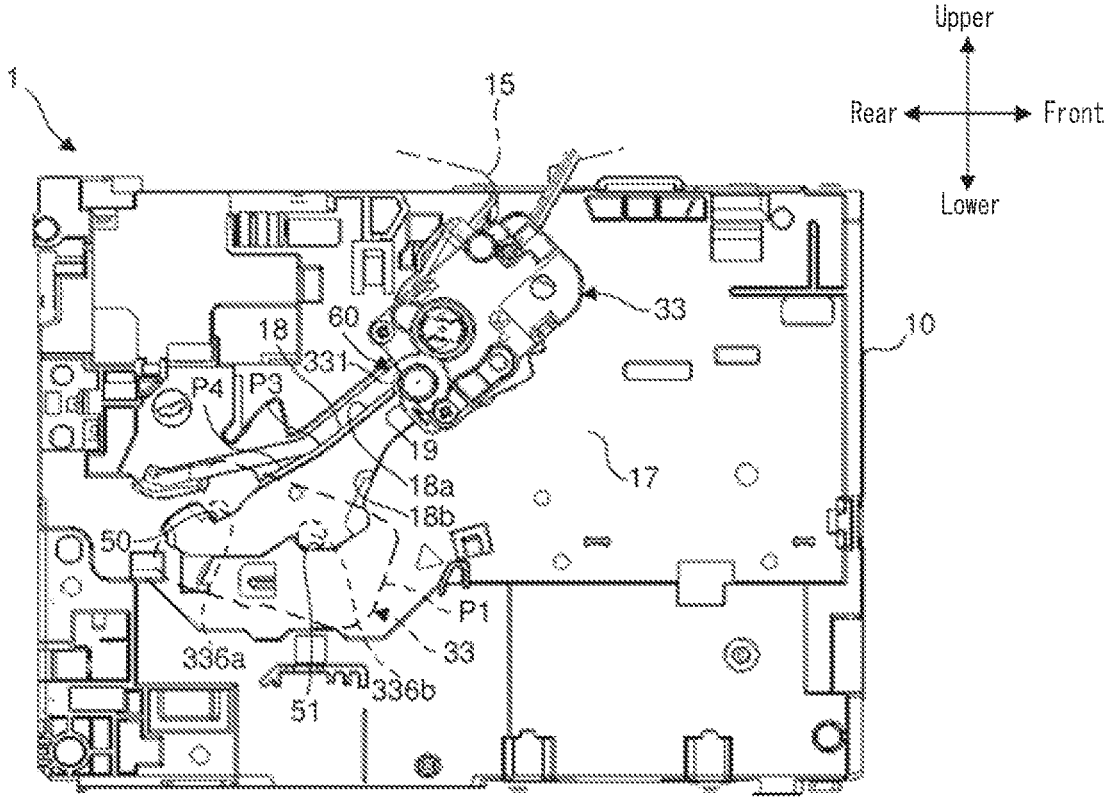
FIG. 3 is a plan view showing the development part 33 which is detached from the main body housing 10 and moves on the largest inclined part P2 of the guide rail 18.

Hereinafter, with reference to the attached drawings, one embodiment of the present disclosure will be described. FIG. 1 is a side sectional view schematically showing a structure of an image forming apparatus 1 according to the present disclosure. FIG. 2 is a plan view showing a guide rail 18 formed in a main body housing 10 and a development part 33 attached to the main body housing 10 at an attachment position P1. FIG. 3 is a plan view showing the development part 33 which is detached from the main body housing 10 and moves on the largest inclined part P2 of the guide rail 18. In FIG. 1, FIG. 2 and FIG. 3, the right side of the drawings is defined as the front side of the image forming apparatus 1 and the left side on the drawings is defined as the rear side of the image forming apparatus 1.

As shown in FIG. 1, the image forming apparatus (a monochrome printer in the embodiment) includes a main body housing 10 (an apparatus main body) formed into an approximately parallelepiped casing structure, a sheet feeding part 20, an image forming part 30, a development part 33 (a development device) and a fixing part 40 which are stored in the main body housing 10. On the front surface of the main body housing 10, a front cover 11 is provided, and on the rear surface of the main body housing 10, a rear cover 12 is provided. In the upper portion of the main body housing 10, a main body opening 15 is provided, and on the upper surface of the main body housing 10, an upper cover 16 is provided so as to open and close the main body opening 15. By opening the upper cover 16, it becomes possible to gain access to the inside of the main body housing 10 through the main body opening 15.

On the upper surface of the upper cover 16, a discharge part 13 to which a sheet (a recording medium) on which an image is formed is discharged is provided. In the following description, the term "sheet" contains a copy paper, an OHP sheet, a coated paper, a cardboard, a postcard, a tracing paper or the like to which an image forming process is subjected.

Each unit of the image forming part 30 and the fixing part 40 is detachable and attachable through the rear surface of the main body housing 10 by opening the rear cover 12. The development part 33 is detachable and detachable through the main body opening 15 by opening the upper cover 16.

As shown in FIG. 1, FIG. 2 and FIG. 3, on a pair of side surfaces 17 facing each other in the sheet width direction (a direction perpendicular to the paper surface of FIG. 1), a guide rail 18 is formed. The guide rail 18 has a rail structure recessed in the sheet width direction. The guide rail 18 extends downward from the main body opening 15 to an attachment position P1 to which the development part 33 described below is attached in the main body housing 10.

As shown in FIG. 2, the guide rail 18 has a plurality of inclined parts (the largest inclined part P2, an intermediate inclined part P3 and the smallest inclined part P4) in the order disposed downward from the main body opening 15 so as to change the inclination gradually. Each inclined part (the largest inclined part P2, the intermediate inclined part P3 and the smallest inclined part P4) is inclined forward and downward. The largest inclined part P2, the intermediate inclined part P3 and the smallest inclined part P4 are arranged so as to be steep as they approach the main body opening 15 from the attachment position P1. The largest inclined part P2 is communicated with the main body opening 15, and is steeper than the intermediate inclined part P3 and the smallest inclined part P4. The smallest inclined part P4 is positioned closest to the attachment part P1 of the development part 33. The smallest inclined part P4 has a gentle inclination as compared with the largest inclined part P2 and the intermediate inclined part P3.

As shown in FIG. 2 and FIG. 3, the guide rail 18 includes a first rail 18*a* and a second rail 18*b* adjacent to each other in the width direction of the development part 33 (the sheet width direction). The first rail 18*a* is disposed more outer side than the second rail 18*b* in the width direction of the development part 33 (the rear side of the paper surface of FIG. 2) than the second rail 18*b*. The first rail 18*a* and the second rail 18*b* are formed so as to be overlapped with each other from the main body opening 15 to a branch portion 18*c* provided in a middle of the guide rail 18 be branched in the upper-and-lower direction from the branch portion 18*c* to the attachment position p1. The first rail 18*a* is formed above the second rail 18*b* from the branch portion 18*c* to the attachment position P1.

In the rear side end portion of the first rail 18*a* (on the side of the attachment position P1), a first recess 50 recessed downward is formed (see FIG. 3). The second rail 18*b* has a second recess 51 recessed downward on the lower and front side of the first recess 50 (see FIG. 3).

Returning to FIG. 1, the sheet feeding part 20 includes a sheet feeding cassette 21 in which the sheet on which the image forming process is subjected is stored. A part of the sheet feeding cassette 21 protrudes from the front surface of the main body housing 10. The upper surface of the sheet feeding cassette 21 stored in the main body housing 10 is covered with a sheet feeding cassette top plate 21U. The sheet feeding cassette 21 includes a sheet storage space in which a bundle of the sheets is stored, a lift plate which lifts the sheet bundle to be fed, and the others. Above the rear end portion of the sheet feeding cassette 21, a sheet feeding part 21A is provided. The sheet feeding part 21A includes a sheet feeding roller 21B which feeds the uppermost sheet of the sheet bundle in the sheet feeding cassette 21 one by one.

The image forming part 30 performs an image forming operation in which a toner image (a developer image) is formed on the sheet fed from the sheet feeding part 20. The image forming part 30 includes a photosensitive drum 31, a charge part 32, an exposure part 35, the development part 33 and a transfer roller 34 which are disposed around the photosensitive drum 31.

The photosensitive drum 31 (an image carrier) includes a rotational shaft and an outer circumferential surface rotating around the rotational shaft. The photosensitive drum 31 is, for example, a known organic photoconductor (OPC), and has the outer circumferential surface made of a photosensitive layer including a charge generating layer, a charge transporting layer, and the others. The photosensitive layer is uniformly charged by the charge part 32 described later, and then is irradiated by the exposure part 35 with light to attenuate the surface potential and to form an electrostatic latent image. Then, on the photosensitive layer, the toner image in which the electrostatic latent image is developed by the development part 33 is carried.

Figure 6:
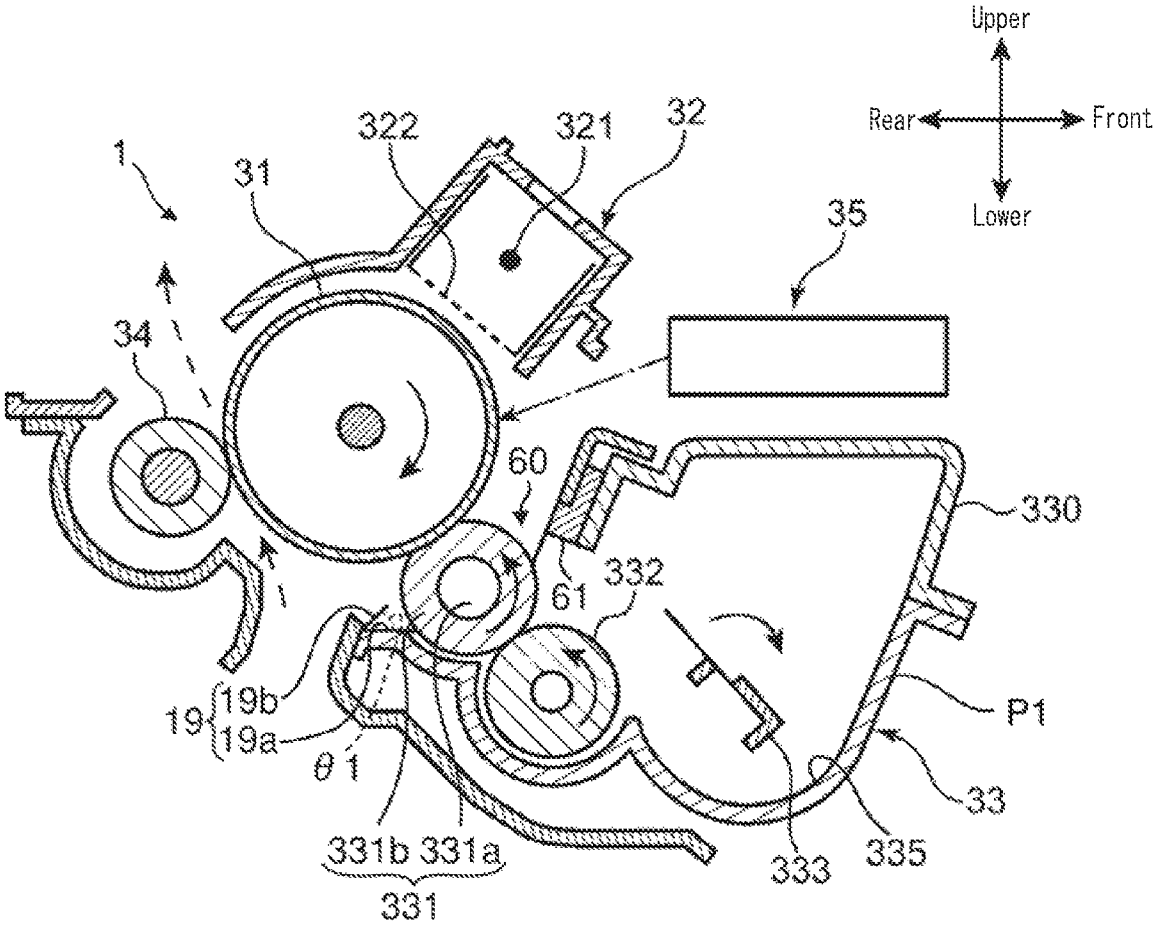
FIG. 6 is an enlarged sectional view showing a photosensitive drum 31, the development part 33 and their peripheries shown in FIG. 1.

The charge part 32 (a charge device) is disposed at a predetermined interval with respect to the outer circumferential surface of the photosensitive drum 31, and uniformly charges the outer circumferential surface of the photosensitive drum 31 in a non-contact state. Specifically, the charge part 32 includes a charge wire 321 and a grid electrode 322 (both are shown in FIG. 6). The charge wire 321 is a linear electrode extending in the rotational axis direction of the photosensitive drum 31, and generates corona discharge between the charge wire 321 and the photosensitive drum 31. The grid electrode 322 is a grid-like electrode extending in the rotational axis direction of the photosensitive drum 31, and is disposed between the charge wire 321 and the photosensitive drum 31. The charge part 32 generates the corona discharge by flowing a current of a predetermined current value through the charge wire 321, and charges the outer circumferential surface of the photosensitive drum 31 facing the grid electrode 322 to a predetermined surface potential uniformly by applying a predetermined voltage to the grid electrode 322.

The exposure part 35 (an exposure device) includes a laser light source and optical elements such as a mirror and a lens, and irradiates the outer circumferential surface of the photosensitive drum 31 with the light modulated based on image data output from an external device, such as a personal computer. Then, the exposure part 35 forms the electrostatic latent image corresponding to an image based on the image data on the outer circumferential surface of the photosensitive drum 31.

As shown in FIG. 1, FIG. 2 and FIG. 3, the development part 33 includes a guide part 336 engageable with the guide rail 18. By engaging the guide part 336 with the guide rail 18, the development part 33 is movable along the guide rail 18 between the main body opening 15 and the attachment position P1. A direction in which the development part 33 is moved is defined as a moving direction. In the moving direction, a side of the attachment position P1 is referred to as the downstream side and a side of the main body opening 15 is referred to as the upstream side. A direction from the upstream side to the downstream side is referred to as an attachment direction.

The guide part 336 has a first engagement portion 336*a* and a second engagement portion 336*b* protruding in the width direction of the development part 33 (the sheet width direction). The first engagement portion 336*a* is provided on the downstream side of the second engagement portion 336*b* in the moving direction. The first engagement portion 336*a* is engageable with the first rail 18*a* and slidable along the first rail 18*a*. The second engagement portion 336*b* is engageable with the second rail 18*b* and slidable along the second rail 18*b*.

As described above, the guide rail 18 is branched at the branch portion 18*c*. Therefore, when the development part 33 is moved from the main body opening 15 toward the attachment position P1, the first engagement portion 336*a* is moved upward along the first rail 18*a* while the second engagement part 336*b* is moved downward along the second rail 18*b*. When the development part 33 reaches the attachment position P1, the first engagement portion 336*a* is fitted into the first recess 50 of the first rail 18*a* and the second engagement portion 336*b* is fitted into the second recess 51 of the second rail 18*b* (see the broken line arrow in FIG. 3). The fitting of the first engagement portion 336*a* in the first recess 50 and the fitting of the second engagement portion 336*b* in the second recess 51 allow the development part 33 to be attached to the main body housing 10.

Returning to FIG. 1, when attached to the main body housing 10 at the attachment position P1, the development part 33 supplies the non-magnetic one component toner (the developer) to the outer circumferential surface of the photosensitive drum 31. Thereby, the electrostatic latent image is developed. The development of the electrostatic latent image shows that the toner image (the developer image) which is a visual image of the electrostatic latent image is formed. The development part 33 will be described later in detail.

The transfer roller 34 is a roller which transfers the toner image formed on the outer circumferential surface of the photosensitive drum 31 to the sheet. Specifically, the transfer roller 34 has an outer circumferential surface rotating around an axis and facing the outer circumferential surface of the photosensitive drum 31 on the downstream side of the development roller 331 (the developer carrier) in the rotational direction of the photosensitive drum 31. The transfer roller 34 transfers the toner image carried on the outer circumferential surface of the photosensitive drum 31 to the sheet passing through a nip area between the transfer roller 34 and the outer circumferential surface of the photosensitive drum 31. At the transferring, the transfer toller 34 is applied with a transfer voltage having a polarity opposite to the toner.

The fixing part 40 performs a fixing processing in which the toner image transferred to the sheet is fixed on the sheet. The fixing part 40 includes a fixing roller 41 and a pressing roller 42. The fixing roller 41 includes a heat source housed therein, and heats the toner transferred to the sheet at a predetermined temperature. The pressing roller 42 is brought into pressure contact with the fixing roller 41 to form a fixing nip area between the fixing roller 41 and the pressing roller 42. When the sheet to which the toner image is transferred is passed through the fixing nip area, the toner image is heated by the fixing roller 41 and pressed by the pressing roller 42 to be fixed on the sheet.

Inside the main body housing 10, a main conveyance path 22F and an inversion conveyance path 22B along which the sheet is conveyed are provided. The main conveyance path 22F extends from the sheet feeding part 21A of the sheet feeding part 20 to a sheet discharge port 14 provided facing the sheet discharge part 13 provided on the upper surface of the main body housing 10 via the image forming part 30 and the fixing part 40. The inversion conveyance path 22B is a conveyance path for returning the sheet formed with the image on one surface to the upstream side of the image forming part 30 on the main conveyance path 22F when the both-side printing is performed on the sheet.

The main conveyance path 22F is extended such that the sheet is conveyed through the transfer nip area between the photosensitive drum 31 and the transfer roller 34 from the lower side to the upper side. On the main conveyance path 22F, a registration rollers pair 23 is disposed on the upstream side of the transfer nip area. The sheet is stopped by the registration rollers pair 23, and then fed to the transfer nip area at a predetermined timing for the image transferring after the skew of the sheet is corrected. At suitable positions on the main conveyance path 22F and the inversion conveyance path 22B, a plurality of conveyance rollers for conveying the sheet is disposed. Near the sheet discharge port 14, a discharge rollers pair 24 is disposed.

The inversion conveyance path 22B is formed between the outer surface of an inversion unit 25 and the inner surface of the rear cover 12 of the main body housing 10. On the inner surface of the inversion unit 25, the transfer roller 34 and one roller of the registration rollers pair 23 are mounted. The rear cover 12 and the inversion unit 25 are rotatable around the supporting point 121 provided in the lower portions thereof. When the sheet jamming occurs on the inversion conveyance path 22B, the rear cover 12 is opened. When the sheet jamming occurs on the main conveyance path 22F, or when the unit of the photosensitive drum 31 or the development part 33 is detached outside, the inversion unit 25 is opened together with the rear cover 12.

Figure 4:
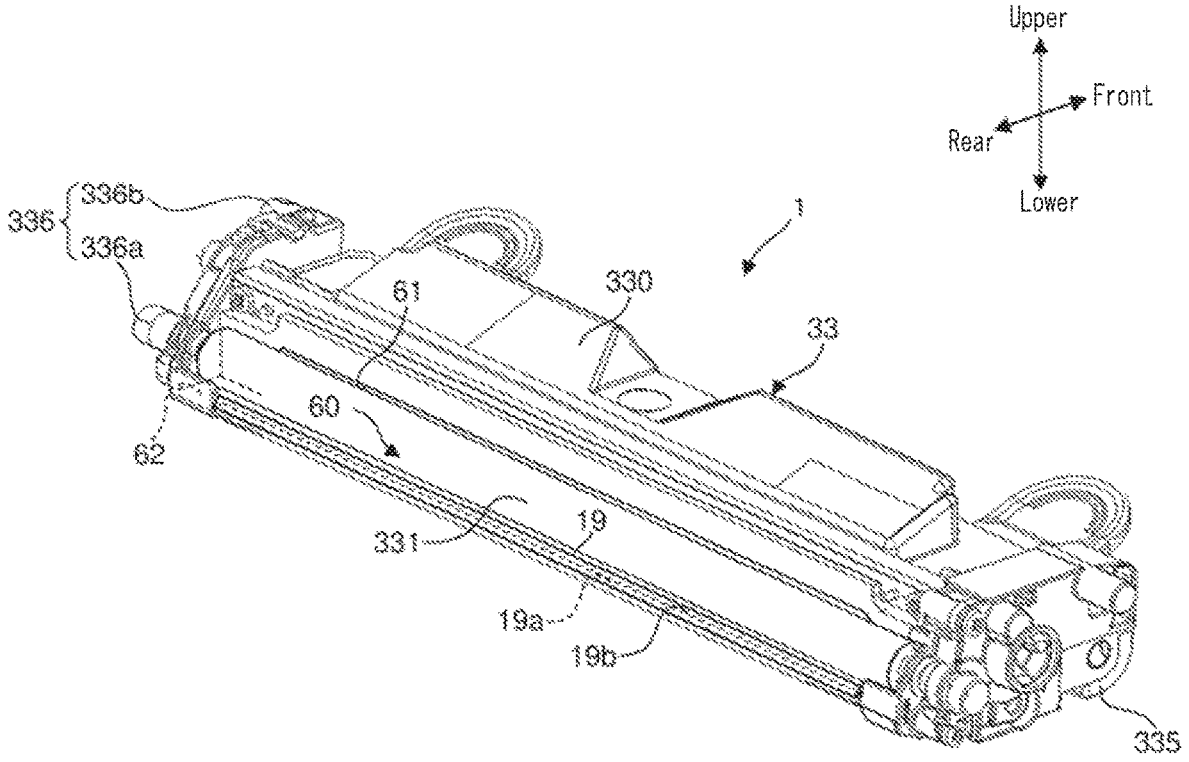
FIG. 4 is a perspective view showing the whole of the development part 33.
Figure 5:
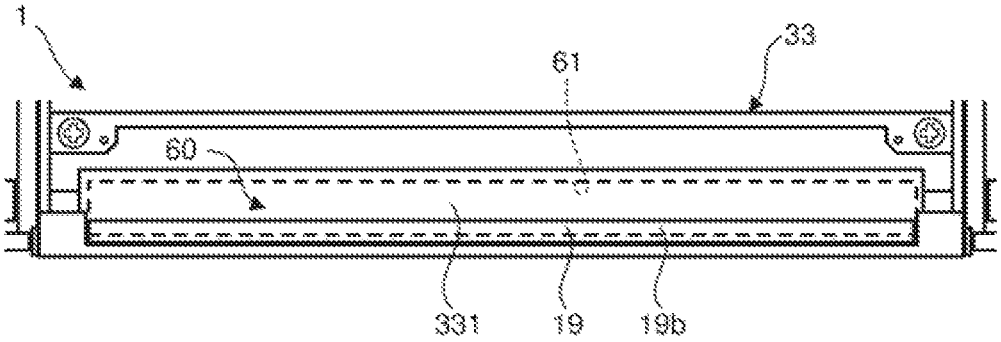
FIG. 5 is a plan view showing the development part 33 viewed from the rear side of the main body housing 10 (the downstream side in the moving direction).

FIG. 4 is a perspective view showing the whole of the development part 33. FIG. 5 is a plan view showing the development part 33 viewed from the rear side of the main body housing 10 (the downstream side in the moving direction). FIG. 6 is an enlarged sectional view showing the photosensitive drum 31, the development part 33 and their peripheries shown in FIG. 1.

As shown in FIG. 4, FIG. 5 and FIG. 6, the development part 33 includes the guide part 336 described above, a development housing 330 (a development container), a development roller 331, a supply roller 332 and an agitating paddle 333.

The development housing 330 contains the non-magnetic one-component developer consisting of a toner only, and the development roller 331 and the supply roller 332 are stored in the development housing 330 (see FIG. 6). The development housing 330 includes an agitating room 335 in which the developer in an agitated state is contained. The development housing 330 has a container opening 60 formed on the rear side of the agitating room 335 in the front-and-rear direction (on the downstream side of the development part 33 in the moving direction). The development roller 331 is disposed so as to face the container opening 60. A part of the development roller 331 is exposed to the outside of the development part 33 through the container opening 60 (see FIG. 4).

Figure 7:
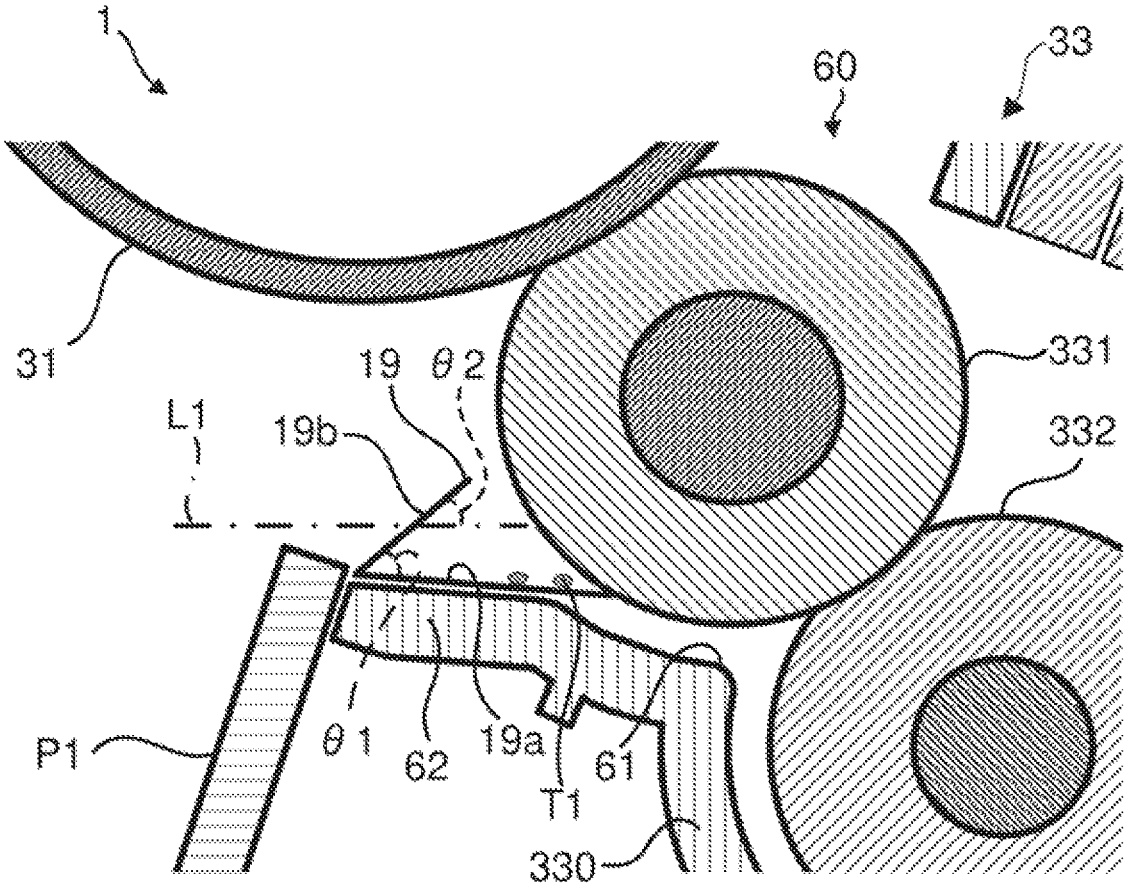
FIG. 7 is an enlarged sectional view showing a container opening 60 and its periphery shown in FIG. 6.

FIG. 7 is an enlarged sectional view showing the container opening 60 and its periphery shown in FIG. 6. As shown in FIG. 6 and FIG. 7, the container opening 60 has an opening hole 61 penetrating the development housing 330 from the outside to the inside, a flat portion 62 provided on the downstream side of the opening hole 61 in the moving direction and a blocking member 19 provided on the flat portion 62. The opening hole 61 is opened to the rear side of the development housing 330 (the downstream side in the moving direction). The opening hole 61 is formed to be long in the width direction of the development part 33 (see FIG. 4 and FIG. 5).

The flat portion 62 is a lower surface of the container opening 60. The flat portion 62 is a flat surface extending from the opening hole 61 to the downstream side end portion of the development part 33 in the moving direction. The flat portion 62 is substantially parallel to the moving direction of the development part 33. As shown in FIG. 7, when the development part 33 is positioned at the attachment position P1, the flat portion 62 is slightly inclined upward to the downstream side in the moving direction.

As shown in FIG. 6 and FIG. 7, the blocking member 19 is disposed in the downstream side end portion of the development housing 330 in the moving direction. The blocking member 19 is long in the width direction of the development part 33 (see FIG. 4 and FIG. 5). The blocking member 19 has a fixed portion 19*a* bonded to the flat portion 62 and a standing wall portion 19*b* standing upward from the downstream side end portion of the fixed portion 19*a* in the moving direction. The fixed portion 19*a* and the standing wall portion 19*b* are formed integrally and made of the same material, and the fixed portion 19*a* and the standing wall portion 19*b* are bent each other via an angle θ1. The upstream side end portion of the fixed portion 19*a* in the moving direction comes into contact with the outer circumferential surface of the development roller 331.

The angle θ1 between the fixed portion 19*a* and the standing wall portion 19*b* is 25° to 65°. As shown in FIG. 7, when the development part 33 is disposed in the attachment position P1, an angle between the standing wall portion 19*b* and the horizontal plane L1 (see the one-dot chain line in FIG. 7), that is an inclination angle θ2 of the standing wall portion 19*b* with respect to the horizontal plane L1 is smaller than the angle θ1 between the fixed portion 19*a* and the standing wall portion 19*b*.

Figure 8:
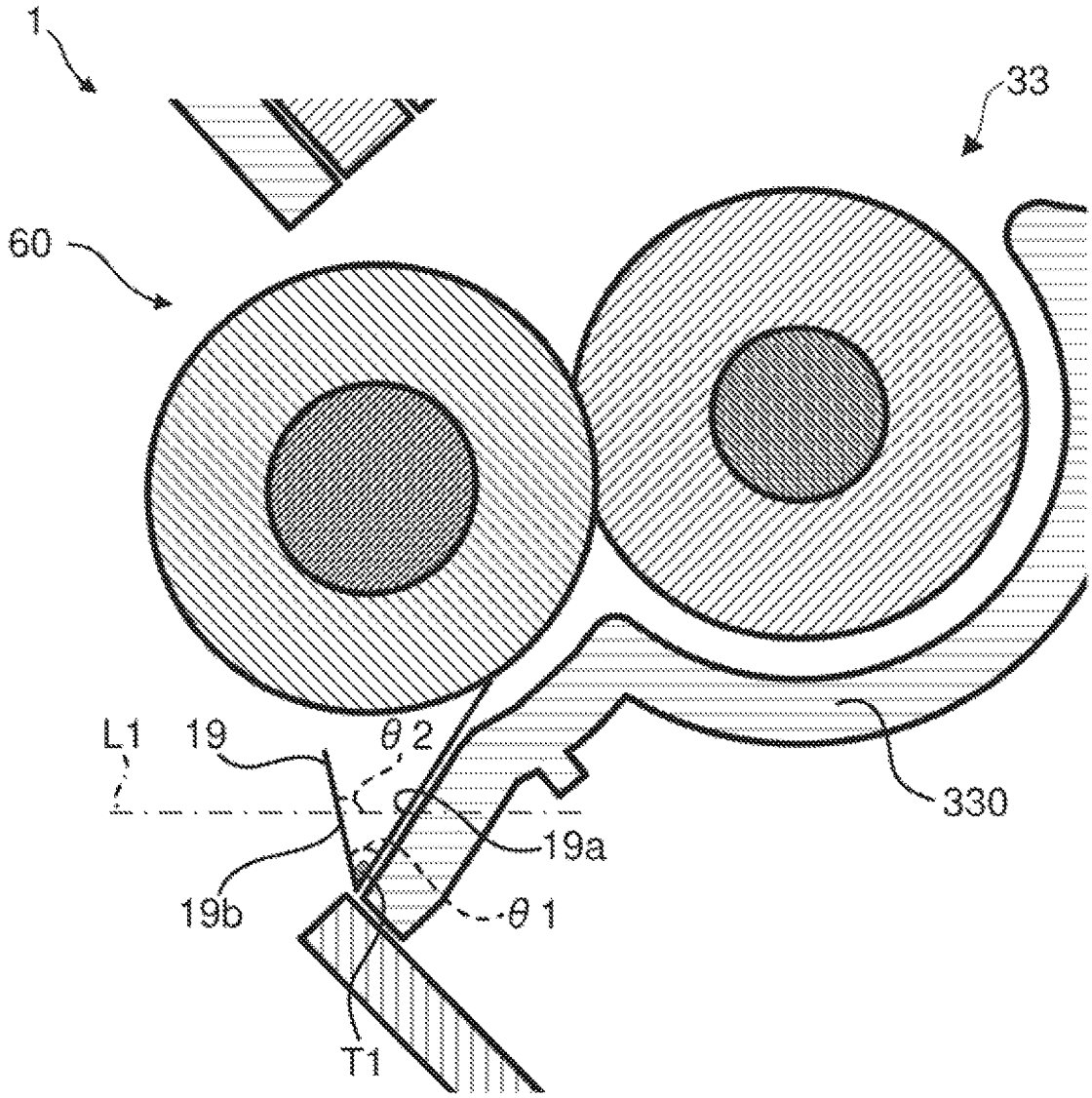
FIG. 8 is an enlarged sectional view showing a blocking member 19 and its periphery in the development part 33 positioned in the largest inclined part P2.

FIG. 8 is an enlarged sectional view showing the blocking member 19 and its periphery in the development part 33 disposed in the largest inclined part P2. As shown in FIG. 8, when the development part 33 is disposed in the largest inclined part P2, the inclination angle θ2 of the blocking member 19 with respect to the horizontal plane L1 is 80° to 130° (preferably, 80° to 95°).

Around the container opening 60 (especially, on the fixed portion 19*a*), the toner scattered when the toner is supplied to the outer circumferential surface of the development roller 331 or when the toner is supplied from the development roller 331 to the photosensitive drum 31 may be accumulated as a waste toner T1 (see FIG. 7). When the development part 33 is disposed in the largest inclined part P2, the waste toner T1 on the fixed portion 19*a* is shifted to the downstream side in the moving direction by its own weight and is accumulated between the standing wall portion 19*b* and the fixed portion 19*a* (see FIG. 8).

Figure 9:
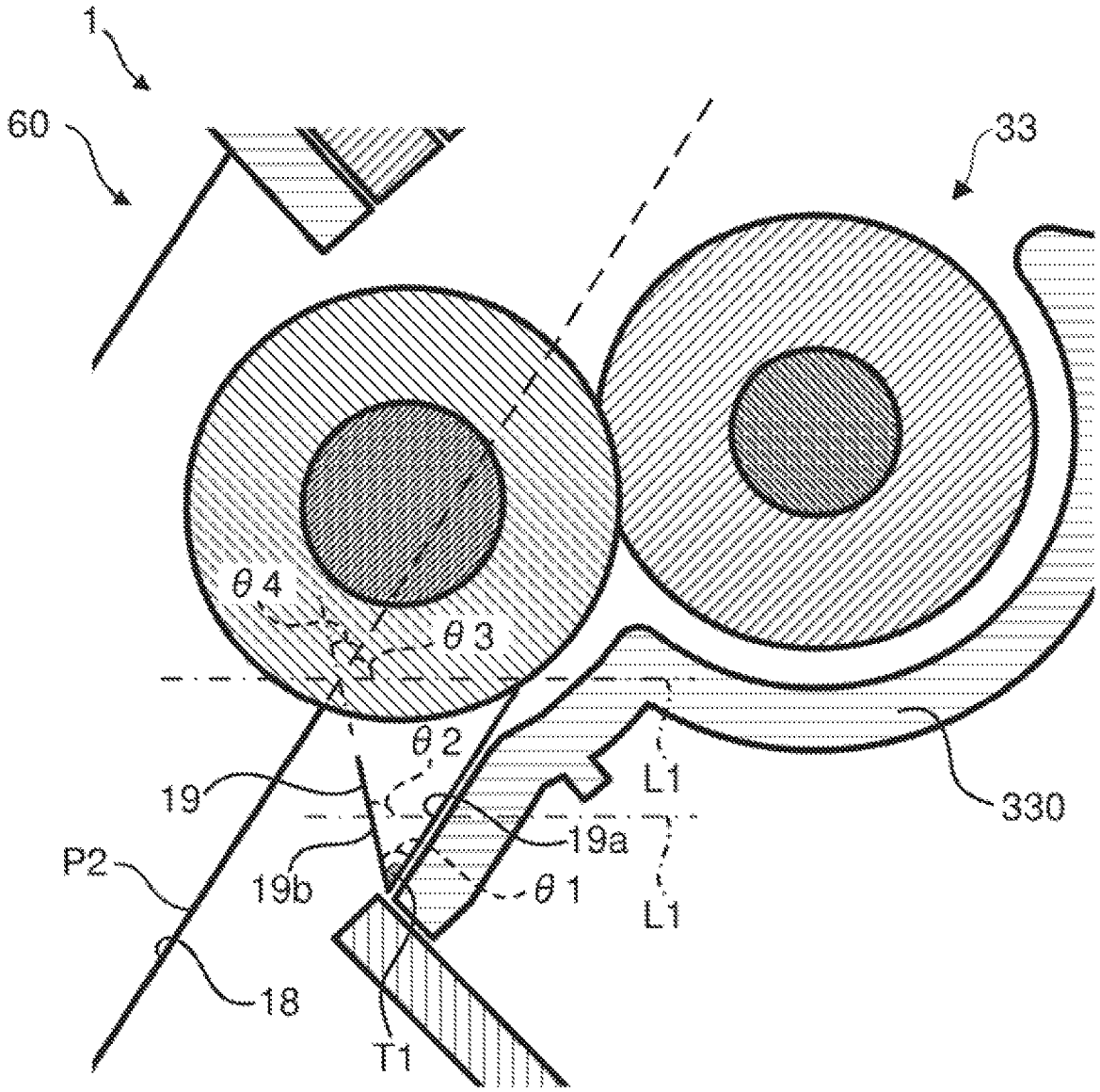
FIG. 9 is an enlarged sectional view showing the development part 33 and its periphery, which showing a relationship of the development part 33 positioned in the largest inclined part P2 and the guide rail 18.

FIG. 9 is an enlarged view showing the development part 33 and its periphery, showing a relationship of the development part 33 disposed in the largest inclined part P2 and the development part 33. The inclination angle θ2 is an angle obtained by adding an angle θ3 of the guide rail 18 with respect to the horizontal plane L1 to an angle θ4 of the standing wall portion 19*b* with respect to the guide rail 18.

As described above, the fixed portion 19*a* is substantially parallel to the moving direction of the development part 33. Because the guide rail 18 extends in the moving direction of the development part 33, the guide rail 18 and the fixed portion 19*a* are substantially parallel to each other. Therefore, the angle θ1 between the fixed portion 19*a* and the standing wall portion 19*b* is almost the same as the angle θ4 of the standing wall portion 19*b* with respect to the guide rail 18 (the angle between the standing wall portion 19*b* and the horizontal plane L1).

Returning to FIG. 6, the agitating room 335 contains the non-magnetic one-component developer in an agitated state. In the agitating room 335, the agitating paddle 333 is disposed. The agitating paddle 333 agitates the developer supplied to the agitating room 335 by a toner supply device (not shown).

The development roller 331 has a rotational shaft 331*a* and a roller part 331*b*. The rotational shaft 331*a* is supported by the development housing 330 with bearings (not shown) in a rotatable manner. The roller part 331*b* is a cylindrical member provided around the outer circumferential surface of the rotational shaft 331*a*, and has a configuration that a coating layer is laminated on a surface of a base rubber (for example, silicone rubber) with an uneven coating material such as urethane. The roller part 331*b* is rotated together with the rotational shaft 331*a* with the rotating of the rotational shaft 331*a*.

The development roller 331 is rotated in a direction from the upstream side to the downstream side (the counterclockwise direction in FIG. 7) in the rotational direction (the clockwise direction in FIG. 7) of the photosensitive drum 31 at a position facing the photosensitive drum 31. That is, the development roller 331 is rotated in the same direction as the photosensitive drum 31 at the position facing the photosensitive drum 31.

The supply roller 332 is disposed facing the development roller 331. The supply roller 332 carries the developer contained in the agitating room 335 on the outer circumferential surface. In addition, the supply roller 332 supplies the developer carried on the outer circumferential surface to the development roller 331.

The supply roller 332 is rotated in a direction from the downstream side to the upstream side (the counterclockwise direction in FIG. 2) in the rotational direction (the counterclockwise direction in FIG. 2) of the development roller 331 at a position facing the development roller 331. That is, the supply roller 332 is rotated in an opposite direction to the development roller 331 at the position facing the development roller 331.

The development roller 331 is supplied with the developer from the supply roller 332 and carries the toner layer on the outer circumferential surface. Then, the development roller 331 supplies the developer to the photosensitive drum 31. The lengths of the development roller 331 and the supply roller 332 in the axial direction (a direction perpendicular to the paper surface on which FIG. 2 is drawn) are almost the same as the length of the photosensitive drum 31 in the axial direction. In order to efficiently move the toner from the development roller 331 to the photosensitive drum 31, a predetermined development voltage is preferably applied to the development roller 331.

The contact area between the fixed portion 19*a* and the development roller 331 described above is located on the downstream side of the facing area between the development roller 331 and the photosensitive drum 31 in the rotational direction of the development roller 331 (the counterclockwise direction in FIG. 7) (see FIG. 6 and FIG. 7). That is, the contact area between the fixed portion 19*a* and the development roller 331 is located below the central axis of the development roller 331. After the toner is supplied from the development roller 331 to the photosensitive drum 31, the remaining toner remaining on the outer circumferential surface of the development roller 331 is scraped by the fixed portion 19*a*. The scraped remaining toner is accumulated on the fixed portion 19*a* as the waste toner T1 (see FIG. 7).

By the way, as describe above, the guide rail 18 extends downward from the main body opening 15 to the attachment portion P1. Therefore, in the image forming apparatus 1, when the development part 33 is attached to the main body housing 10 (when the development part 33 is moved along the guide rail 18), the downstream side portion of the development part 33 in the moving direction, that is the container opening 60 faces downward. As described above, around the container opening 60, the waste toner T1 may be accumulated. Then, if the development part 33 is not provided with the blocking member 19, the waste toner T1 accumulated around the container opening 60 may fall in the inside of the main body housing 10. If the waste toner T1 fallen in the main body housing 10 may be attached on the photosensitive drum 31 or another unit, an image defect such as a transfer of the waste toner T1 to the sheet may be caused.

As described above, the development part 33 according to the present disclosure is provided with the blocking member 19 standing upward from the lower end portion of the container opening 60 at the downstream side position of the development housing 330 in the moving direction. Therefore, when the development part 33 faces downward at the time of the attachment of the development part 33 to the main body housing 10, the waste toner T1 around the container opening 60 is blocked by the blocking member 19, so that the waste toner T1 is prevented from falling in the main body housing 10. Further, as described above, when the development part 33 is located at a position where the inclination of the guide rail 18 is largest (the largest inclined part P2), the inclination angle θ2 of the blocking member 19 with respect to the horizontal plane is 80° to 130°. According to the configuration, the waste toner T1 blocked by the blocking member 19 is hard to get over the blocking member 19, and it becomes possible to suppress the falling of the waste toner T1 more effectively.

Accordingly, it becomes possible to suppress the falling of the waste toner T1 from the periphery of the container opening 60 in the main body housing 10, and to provide the image forming apparatus 1 capable of suppressing the occurrence of the image defect.

Furthermore, by setting the inclination angle θ2 to 80° to 95° when the development part 33 is disposed in the largest inclined part P2, the waste toner T1 is further hard to get over the blocking member 19, and it becomes possible to suppress the falling of the waste toner T1 more effectively.

Furthermore, as described above, the blocking member 19 has the fixed portion 19*a* bonded to the lower surface (the flat portion 62) of the container opening 60 and the standing wall portion 19*b* standing upward from the downstream side end portion of the fixed portion 19*a* in the moving direction. The standing wall portion 19*b* and the fixed portion 19*a* are integrally formed into one body. According to the configuration, because there is no gap between the standing wall portion 19*b* and the fixed portion 19*a*, it becomes possible to suppress the falling of the waste toner T1 more effectively.

Furthermore, as described above, the angle θ1 between the fixed portion 19*a* and the standing wall portion 19*b* is set to 25° to 65°. By setting the angle θ1 in the above manner, regardless of the inclination of the guide rail 18, the waste toner T1 is hard to fall from the development part 33 when the container opening 60 of the development part 33 faces downward. Therefore, the waste toner T1 around the container opening 60 is hard to fall at timings when the development part 33 is attached to and detached from the inside of the main body housing 10 through the main body opening 15. Then, for example, when the development part 33 is replaced, it becomes possible to suppress the falling of the waste toner in the main body housing 10.

Furthermore, as described above, the upstream side end portion of the fixed portion 19*a* in the moving direction comes into contact with the development roller 331 below the axis of the development roller 331. According to the configuration, the toner remaining on the outer circumferential surface of the development roller 331 can be scraped by the upstream side end portion of the fixed portion 19*a* and be received on the fixed portion 19*a*. Therefore, it becomes possible to clean the remaining toner on the outer circumferential surface of the development roller 331 and to suppress the occurrence of the image defect. Further, by the contact between the fixed portion 19*a* and the development roller 331, a gap between the development roller 331 and the development housing 330 can be blocked (see FIG. 6). Then, the developer in the agitating room 335 is prevented from being flowed out through the gap between the development roller 331 and the development housing 330.

When the development part 33 is disposed in the attachment position P1, the angle between the blocking member 19 and the horizontal plane is 25° to 65°. By setting the angle between the blocking member 19 and the horizontal plane to the above angle, when the development part 33 reaches the largest inclined part P2, the waste toner T1 is easily blocked by the blocking member 19, and it becomes possible to suppress the falling the waste toner T1 effectively.

The present disclosure is not limited to the above embodiments, and can be variously modified without departing from the spirit of the present disclosure. For example, although the monochrome printer has been described as an example of the image forming apparatus 1 in the above embodiment, it can also be applied to a tandem type or a rotary type color printer, for example. The present invention is also applicable to an image forming apparatus such as a copying machine, a facsimile machine, or a multifunction machine having these functions.

Further, although the developer of the above embodiment is a nonmagnetic one-component developer containing only a toner, a two-component developer containing a toner and a carrier may be used.

The above embodiment includes three inclined parts of the largest inclined part P2, the intermediate inclined part P3 and the smallest inclined part P4, but may include more than three inclined parts. In this case, the inclined part having the largest inclination among the inclined parts is defined as the largest inclined part P2.

Although the fixed portion 19*a* of the above embodiment is bonded to the flat portion 62, it may be fixed to the flat portion 62 by a method other than the bonding. As a specific example of a method other than the bonding, there is a method in which a fixing member such as a screw is used to held the fixed portion 19*a* to the flat portion 62.

The blocking member 19 may be composed of only the flat standing wall portion 19*b* which is not bent. In this case, the standing wall portion 19*b* can be directly fixed to the flat portion 62. The standing wall portion 19*b* may be formed integrally with the development part 33.

The present disclosure is applicable for an image forming apparatus provided with a development part which performing a development using a developer containing a toner. By using the present disclosure, when the development part is attached to the apparatus main body of the image forming apparatus, the toner hardly falls in the apparatus main body, and it becomes possible to provide the image forming apparatus capable of suppressing the occurrence of an image defect.

The invention claimed is:

1. An image forming apparatus comprising:

an apparatus main body;

an image carrier provided in the apparatus main body and carrying a toner image to be formed on a recording medium;

a development device provided to be attachable to and detachable from an attachment position in the apparatus main body, and supplying a toner to an outer circumferential surface of the image carrier;

a main body opening formed on an upper surface of the apparatus main body; and a guide rail extending downward from the main body opening to the attachment position, wherein the development device includes a development container in which a developer containing the toner is stored, a developer carrier which carries the developer and a guide part provided on an outside of the development container and engageable with the guide rail, and is movable along the guide rail between the main body opening and the attachment position, the development container has:

a container opening which is opened to a downstream side in an attachment direction of the development device to the attachment position and through which a part of the developer carrier is exposed; and a blocking member which is provided on the downstream side of the container opening in the attachment direction and stands upward from a lower end portion of the container opening, wherein the blocking member has a fixed portion fixed on a lower surface of the container opening and a standing wall portion standing upward from a downstream side end portion of the fixed portion in the attachment direction, wherein the fixed portion and the standing wall portion are formed integrally, and when the development container is disposed in a position where an inclination of the guide rail is largest, an inclination angle of the blocking member to a horizontal plane is obtained by adding an angle of a largest inclined part of the guide rail with respect to the horizontal plane to an angle of the standing wall portion with respect to the guide rail, and is 80° to 130°.

2. The image forming apparatus according to claim 1, wherein the fixed portion extends along the lower surface of the development container parallel to a moving direction of the development device, and an angle between the standing wall portion and the fixed portion is 25° to 65°.

3. The image forming apparatus according to claim 1, wherein an upstream side end portion of the fixed portion in the attachment direction comes into contact with the developer carrier below a central axis of the developer carrier.

4. The image forming apparatus according to claim 3, wherein the fixed portion is configured so as to scrape the toner remaining on the developer carrier and to receive the scraped toner.

5. The image forming apparatus according to claim 1, wherein an angle between the blocking member and the horizontal plane when the development device is positioned at the attachment position is 25° to 65°.

6. The image forming apparatus according to claim 5, wherein the angle between the blocking member and the horizontal plane when the development device is positioned at the attachment position is smaller than an angle between the standing wall portion and the fixed portion of the blocking member.

7. The image forming apparatus according to claim 1, wherein the guide rail is formed so as to be steeper toward an upstream side in the attachment direction.

* * * * *